US006486782B1

(12) United States Patent
Zarembo et al.

(10) Patent No.: US 6,486,782 B1
(45) Date of Patent: Nov. 26, 2002

(54) DEVICE FOR CHANGING THE STATUS OF DUAL STATUS MAGNETIC ELECTRONIC ARTICLE SURVEILLANCE MARKERS

(75) Inventors: Peter J. Zarembo, Shoreview; Anthony M. Belka, Stillwater, both of MN (US)

(73) Assignee: 3M Innovative Properties, St. Paul, MN (US)

( * ) Notice: Subject to any disclaimer, the term of this patent is extended or adjusted under 35 U.S.C. 154(b) by 0 days.

(21) Appl. No.: 09/611,248

(22) Filed: Jul. 7, 2000

(51) Int. Cl.[7] ..... G08B 13/14
(52) U.S. Cl. ..... 340/572.3; 340/572.1
(58) Field of Search ..... 340/572.3, 572.1, 340/568.1; 361/149; 700/225

(56) References Cited

U.S. PATENT DOCUMENTS

| | | | | | |
|---|---|---|---|---|---|
| 3,765,007 | A | * | 10/1973 | Elder | 340/572.3 |
| 4,575,624 | A | * | 3/1986 | Klinkhardt | 235/449 |
| 4,665,387 | A | * | 5/1987 | Cooper et al. | 340/572.3 |
| 4,673,923 | A | * | 6/1987 | Boscoe et al. | 340/572.3 |
| 4,906,974 | A | | 3/1990 | Rehder | 340/551 |
| 5,059,951 | A | | 10/1991 | Kaltner | 340/572.3 |
| 5,257,010 | A | | 10/1993 | Rehder | 340/572 |
| 5,285,182 | A | | 2/1994 | Zarembo | 335/284 |
| 5,315,096 | A | | 5/1994 | Müller et al. | 235/462 |
| 5,477,202 | A | | 12/1995 | Zarembo et al. | 335/284 |
| 5,534,836 | A | * | 7/1996 | Schenkel et al. | 335/284 |
| 5,625,339 | A | | 4/1997 | Zarembo et al. | 340/551 |
| 5,699,047 | A | | 12/1997 | Tsai et al. | 340/572.6 |
| 5,705,986 | A | * | 1/1998 | Zschirnt | 340/572.3 |
| 5,777,884 | A | * | 7/1998 | Belka et al. | 700/225 |
| 5,818,336 | A | * | 10/1998 | Varga et al. | 340/545 |
| 5,825,292 | A | | 10/1998 | Tsai et al. | 340/572.6 |
| 5,867,101 | A | | 2/1999 | Copeland et al. | 340/572 |
| 5,990,794 | A | | 11/1999 | Alicot et al. | 340/573.1 |
| 6,002,335 | A | * | 12/1999 | Zarembo et al. | 340/572.1 |
| 6,011,474 | A | * | 1/2000 | Coffey et al. | 340/572.3 |
| 6,111,507 | A | | 8/2000 | Alicot et al. | 340/572 |
| 6,169,483 | B1 | * | 1/2001 | Ghaffari et al. | 3340/572.3 |
| 6,195,007 | B1 | * | 2/2001 | Takayama et al. | 340/572.1 |
| 6,201,474 | B1 | * | 3/2001 | Brady et al. | 340/572.8 |
| 6,232,870 | C1 | | 5/2001 | Garber et al. | 340/10.1 |

FOREIGN PATENT DOCUMENTS

| | | | |
|---|---|---|---|
| EP | 0 287 905 A1 | 10/1988 | G08B/13/24 |
| EP | 0 454 021 A1 | 10/1991 | G08B/13/24 |
| EP | 0 499 582 A1 | 8/1992 | G08B/13/24 |
| EP | 0 703 552 A1 | 3/1996 | G08B/13/24 |
| EP | 0 715 284 A2 | 6/1996 | G08B/13/24 |
| EP | 0 049 115 A1 | 11/2000 | H01F/13/00 |
| WO | WO 95/08177 | 3/1995 | H01F/7/20 |
| WO | WO 98/13805 | 4/1998 | |

* cited by examiner

*Primary Examiner*—John Tweel
(74) *Attorney, Agent, or Firm*—Peter L. Olson

(57) ABSTRACT

A device is disclosed for activating and deactivating magnetic electronic article surveillance (EAS) markers, and particularly those EAS markers that are associated with magnetically recorded media. In one embodiment, the device includes control circuitry comprising a coil, such as a solenoid-type coil, that provides a substantially uniform magnetic field that reliably activates and deactivates the marker, yet doesn't damage the magnetically-recorded media.

24 Claims, 3 Drawing Sheets

DEVICE FOR CHANGING THE STATUS OF DUAL STATUS MAGNETIC ELECTRONIC ARTICLE SURVEILLANCE MARKERS

TECHNICAL FIELD

The present invention relates to a device for changing the status of a dual status magnetic electronic article surveillance marker.

BACKGROUND OF THE INVENTION

Magnetic electronic article surveillance ("EAS") markers have been used for many years to protect items of value against theft. These EAS markers typically have a signal producing layer made of a low coercive force, high permeability magnetic material, and a continuous or segmented signal blocking layer made of a permanently magnetizable magnetic material. When the signal blocking layer is activated, it effectively prevents the signal producing layer from providing a signal that is detectable by an EAS detection system, and thus the EAS marker is deactivated. When the signal blocking layer is deactivated, then the EAS marker is activated, and an EAS detection system is able to detect the marker. EAS markers that may be activated and deactivated as described are sometimes referred to as "dual-status" markers, to distinguish them from "single-status" markers that are always activated. Billions of dual-status EAS markers have been sold to date, and they protect assets such as library materials against theft around the world.

The devices used to activate and deactivate magnetic EAS markers are themselves magnetic. That is, they may include an array of magnets or an electric coil that produces a magnetic field of a desired intensity near a working surface, so that the EAS markers may be passed over that surface to selectively activate or deactivate the marker. Unfortunately, some devices used to change the status of a dual-status marker have the potential to harm magnetically-recorded media, such as videotapes. That is, magnetically-recorded media can be erased, garbled, or damaged by the presence of a magnetic field. Thus, when magnetically-recorded media are passed over a device to change the status of an EAS marker attached thereto, the device may damage the magnetically-recorded media. In view of the foregoing, it is desirable to provide a device for deactivating dual-status magnetic EAS markers that will not damage magnetically-recorded media such as videotapes.

Conventional activation and deactivation systems may reliably activate or deactivate EAS markers positioned along the spine of a book, for example, because the position and orientation of the marker relative to the magnetic field is generally known. With a compact disc, the EAS marker is likely to be positioned on the disc itself, and thus may be at any orientation in the X-Y plane relative to the case in which the disc is contained, and thus relative to the applied magnetic field. Conventional devices have compensated for this uncertainty by generating a more intense magnetic field, and although this increases the reliability of activation and deactivation, it can interfere with cathode-ray tubes (CRTs) located in the vicinity of the device. Furthermore, some patrons may perceive a health concern with elevated magnetic fields (whether justified or not), and thus may not wish to use such a conventional activation/deactivation device. Thus it would also be desirable to provide a device that overcomes these concerns.

SUMMARY OF THE INVENTION

Attempts have been made in the past to provide a device for changing the status of dual-status magnetic EAS markers without damaging magnetically-recorded media by controlling the intensity of the magnetic field within a short distance of a working surface, so that the marker may be deactivated or reactivated without damage to the magnetically-recorded media. That is, the magnetic field is strong enough at one distance (corresponding to the expected position of the EAS marker) to deactivate the marker, but is not strong enough at a second, greater distance (corresponding to the expected position of the magnetically-recorded media) to damage the magnetically-recorded media. These fields have generally been created using an array of individual magnets, or an open coil. Although this distance-dependent approach has met with some success, it requires the user to locate the EAS marker so that the EAS marker can be passed over the working surface in the intended manner. This normally requires that the magnetically-recorded media be removed from its case or container, which is time-consuming. Also, if for some reason the magnetic field above the working surface is greater than expected or designed, damage to the magnetic media can still result.

In one embodiment, the present invention overcomes these difficulties in the following manner. A magnetic field that is substantially uniform within an area of interest is produced at an intensity that is sufficiently high to reliably activate or deactivate the EAS marker, but sufficiently low to prevent damage to the magnetically-recorded media, such as videotape. Common videotapes, for example, may be damaged when exposed to magnetic fields of approximately 590 Gauss or more, and may show some negative effects when exposed to magnetic fields of 560 Gauss or more. On the other hand, many magnetic EAS markers require a field of approximately 275 Gauss to be reliably activated and deactivated. Accordingly, if a field that is substantially uniform within an area of interest is created, dual-status EAS markers can be reliably activated and deactivated without risking damage to the magnetically-recorded media to which they are attached.

In another aspect, the device of the present invention can be used to reliably change the status of a dual-status EAS marker attached to optically-recorded media such as a compact disc. The inventive device can provide a constant magnetic field within an area of interest that is sufficient to deactivate or reactivate the marker regardless of its orientation in the X and Y direction, while in at least one embodiment minimizing or eliminating any magnetic field effects to which a person is likely to be exposed while using the device.

In one embodiment, the device of the invention selectively produces magnetic fields of different intensity by changing the reactance of the LCR circuit, rather than by changing the voltage. This is more efficient and requires fewer components, thus enabling the electronic package to be smaller.

These and other aspects of the present invention, including the use of radio-frequency identification ("RFID") tags and interrogators, are described in much greater detail below.

BRIEF DESCRIPTION OF THE DRAWINGS

The present invention will be described with reference to the attached Figures, in which.

DETAILED DESCRIPTION OF THE INVENTION

Figure 1:
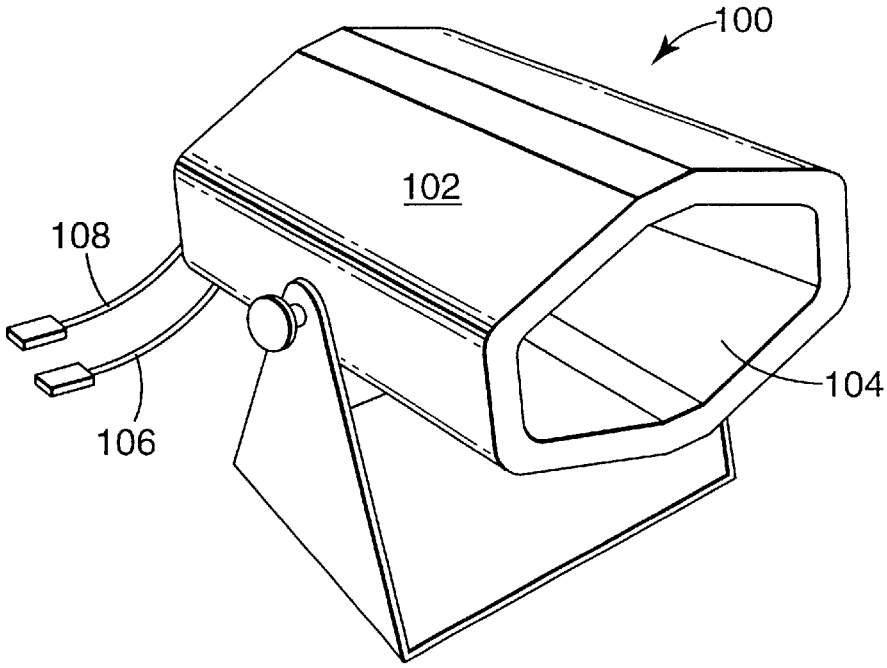
FIG. 1 is a perspective view of one embodiment of the device of the present invention.

One embodiment of the device of the present invention reliably activates and deactivates dual-status magnetic EAS markers using a substantially uniform magnetic field. The substantially uniform magnetic field is preferably created by a solenoid-type coil. A solenoid is normally a cylindrical coil having a passageway therethrough, and a solenoid-type coil, as that term is used in regard to the present invention, is a coil that has a passageway therethrough although its cross-section may not be circular. The cross-section of the housing shown in FIG. 1, for example, is not circular, but can house a solenoid-type coil of the type described herein.

Using this type of coil, the intensity of the magnetic field can be maintained throughout a volume of interest at an intensity above that needed to activate or deactivate an EAS marker, but below that at which magnetically-recorded videotape, for example, is damaged. As a result, magnetically-recorded media such as videotapes to which the EAS marker is attached may be protected by such markers without concern for damage to the media. Another important benefit is that the videotape may remain in the protective case in which it is stored, which saves considerable time for users who have to check many such items out to or in from patrons, or both. These and other benefits will be described in more detail below.

To simplify the description of the present invention, magnetic EAS markers will be described in Section I below, characteristics of magnetic fields used to change the status of such markers in accordance with the present invention will be described in Section II, various embodiments of devices for changing the status of such markers in accordance with the present invention will be described in Section III, and representative circuits will be described in Section IV.

I. Magnetic EAS Markers

Any suitable magnetic EAS marker may be used in conjunction with the device of the present invention, such as those available from the Minnesota Mining and Manufacturing Company of St. Paul, Minn. (3M) under the designation "TATTLE-TAPE." These can include EAS markers for books (designated by 3M as B1, B2, or R2, for example), videotapes (designated by 3M as DVM-1), or CDs (designated by 3M as DCD-2). These magnetic EAS markers include a signal producing layer and a signal blocking layer. As is well-known in the art, when the signal-blocking layer is activated, it effectively prevents detection of signals created by the signal-producing layer. When the signal-blocking layer is deactivated, the signal-producing layer when subjected to the interrogating magnetic field can be detected by a suitable detection system.

The signal producing layer for EAS markers for CD's, such as the DCD-2, is about 7.7 cm (3 in) long, 1 mm (0.04 in) wide, and 180 micrometers (0.007 in) thick, and is made from an amorphous magnetic alloy consisting of about 67% (atomic percent) cobalt, 5% iron, 25% boron and silicon, which is presently commercially available from Honeywell (formerly AlliedSignal) Corporation of Parsippany, N.J. under the designation 2705 M. The signal producing layer element was annealed to reduce the coercivity and to enhance anisotropy in the cross web direction. The signal producing layer for EAS markers for videotapes, such as the DVM-1, is about 13.6 cm (5.375 in) long, 3.18 mm (0.125 in) wide and 180 micrometers (0.007 in) thick, and is made from an iron/nickel composition of the type presently available from Carpenter Technology Corporation of Reading, Pa. under the designation PERMALLOY™.

The signal-blocking layer of the EAS markers described above includes a plurality of spaced segments. For EAS markers such as the DCD-2, each segment is approximately 5 mm (0.20 in) long, 1 mm (0.04 in) wide and 40 micrometers (0.0016 in) thick, and for the DVM-1 marker, each segment is approximately 5 mm (0.2 in) long, 3 mm (0.125 in) wide and 40 micrometers (0.0016 in) thick. The signal blocking layer is made from an alloy of iron and chromium that is presently commercially available from Arnold Engineering of Marengo, Ill. under the designation Arnokrome 3. In one embodiment, the signal blocking layer segments were annealed to provide a uniform coercivity of about 200+/−30 Oersteds. As described above, the signal-blocking layer is typically provided in discrete pieces at intervals along the length of the signal-producing layer, though other arrangements including contiguous signal blocking layers are suitable as well.

II. Characteristics of the Magnetic Field Associated with the Device of the Present Invention As noted above, an important feature of the device of the present invention is its ability to produce a magnetic field that reliably activates and deactivates magnetic EAS markers, and yet does not damage magnetically-recorded media such as videotape.

A. Changing the Status of the EAS Marker

The EAS marker of the type described above is normally activated by deactivating the signal-blocking layer. That step can be achieved by, for example, exposing the marker to an initial magnetic field in one preferred direction of at least approximately 275 Gauss and then alternating and decreasing the magnetic field in steps of about 15% per each incremental decrease until the magnetic field is below about 80 Gauss. This is described in, for example, U.S. Pat. No. 6,002,335 (Zarembo et al.), particularly in regard to FIGS. 3 and 4 thereof. To deactivate the EAS marker, the signal blocking layer is activated by, for example, exposing the marker once to a single magnetic field having an intensity of at least approximately 275 Gauss. As such, whereas deactivation of the signal blocking layer involves exposure of the layer to a decreasing sine wave (i.e., one that alternates and decreases in intensity, and which is referred to as "ringing down" the field), activation of the signal blocking layer only requires that the layer be exposed to one pulse or half of a sine wave that is at least 275 Gauss in intensity.

B. Prevention of Damage to Magnetically-Recorded Media

The characteristics of magnetically-recorded media are different between different types of such media, and will likely change over time. Current standard VHS videotapes and videotapes such as those used in handheld consumer video cameras can generally be exposed to a magnetic field of up to approximately 590 Gauss without being damaged in a manner that is perceptible to most observers. Further, repeated exposure of current videotapes to magnetic fields of less than approximately 590 Gauss typically does not result in discernable damage to the tape.

C. Substantially Uniform Magnetic Field

The magnetic field produced by the device of the present invention should be substantially uniform. The term "substantially uniform," as used in regard to this invention, means that the field within an area of interest (defined below) is always less intense than the level at which magnetically-recorded media such as videotape is damaged, but is always more intense than the level at which the magnetic EAS marker is reliably activated or deactivated. For example, if magnetically-recorded media is damaged when exposed to magnetic fields of 560 Gauss or more, and if magnetic EAS markers are reliably activated or deactivated when exposed to magnetic fields of at least 275 Gauss, then a "substantially uniform" field within the meaning of the present invention is a field that within the zone of interest is between 275 and 560 Gauss. That is, substantially uniform is defined by the boundaries set by the intensity level at which the magnetic media can be damaged (the upper end of the range) and the intensity level at which the magnetic EAS marker can be reliably activated or deactivated (the lower end of the range). The substantially uniform field of the present invention may also be substantially uniform in the conventional sense (meaning that its intensity would be approximately the same at all locations), but conventional uniformity of field intensity is very difficult to achieve in practice particularly near the ends of a magnetic coil, and is not a requirement of the present invention.

The zone of interest is defined as the area or volume that includes both the magnetically-recorded media and the magnetic EAS marker. If a field is substantially uniform within a zone of interest, then magnetically-recorded media can generally be passed through that magnetic field either within or without their storage cases and yet have the associated magnetic EAS markers be reliably activated or deactivated. Because the size of the storage case, including the position in which the magnetically-recorded media is carried within the storage case, can vary, field uniformity can be very important. Also, as mentioned above, a solenoid-type coil can create a substantially uniform magnetic field throughout the volume of a device, thus allowing activation and deactivation of an EAS marker without exposing the magnetically-recorded tape to a magnetic field that could cause damage to the tape.

III. Devices for Changing the Status of EAS Markers

Another aspect of the present invention is a device that reliably creates a substantially uniform field of the type described above. That is, even if there has been an abstract suggestion of the desirability for a substantially uniform field, no operational devices are known to exist that would provide a substantially uniform field suitable for the applications described herein. The embodiment of the device described herein is illustrative, and other embodiments that can perform the same or similar functions can be designed by one of ordinary skill in the art based on the following description.

FIG. 1 illustrates one embodiment of the device 100 of the present invention. It includes a body 102 and a passageway 104 therethrough, and can be inclined so that an object inserted in one end of the passageway will move downward and exit the other end of the passageway. In another embodiment, the passageway is closed at one end, so that the videotape or other object is simply inserted into and removed from the same end of the passageway. Variations on the physical design of the device 100 are certainly possible, and can include designs in which the passageway is generally horizontal (perhaps with some conveyer, a driving mechanism, or other device to move the object through the passageway), for example. Device 100 typically also includes a power connection 106 and, if all of the control circuitry is not contained within the housing, connecting circuitry 108.

Figure 2:
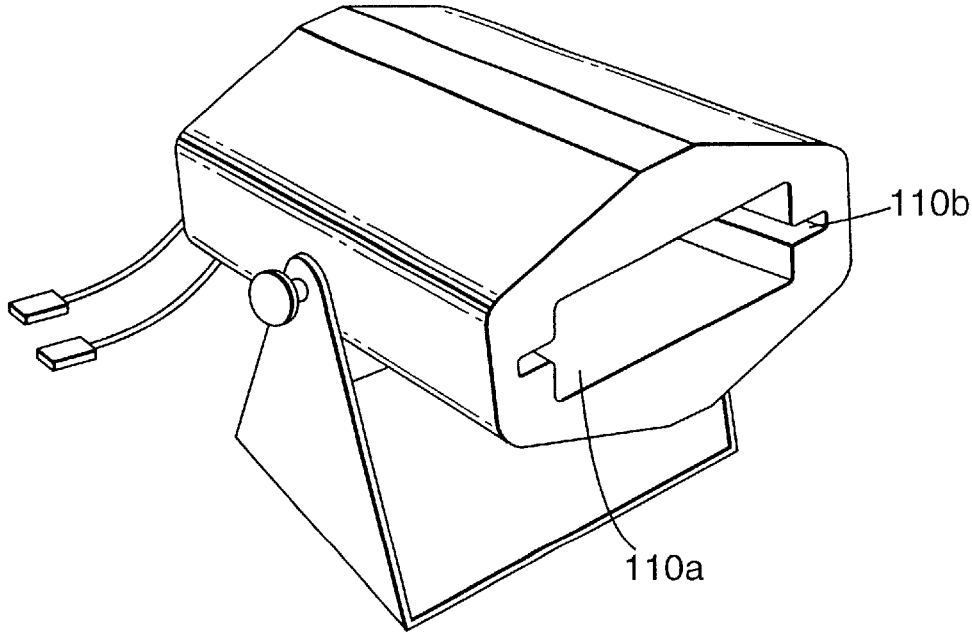
FIG. 2 is a perspective view of another embodiment of the device of the present invention.

The opening of the passageway could instead be designed as shown in FIG. 2 so that only objects having a known profile would fit into the passageway. The opening or passageway 110*a* shown in FIG. 2 is dimensioned to receive cased videotapes in a known orientation, and opening or passageway 110*b* is dimensioned to receive cased compact discs in a known orientation. When the orientation of the item, such as a videotape, and its associated marker is known (perhaps due to the use of the openings shown in FIG. 2), then the intensity of the applied magnetic field can be controlled to provide for reliable activation and deactivation of the marker. This represents an improvement over conventional devices in which videotapes and compact discs may be presented to the device at almost any orientation relative to the device.

IV. Circuit Diagrams

Figure 3:
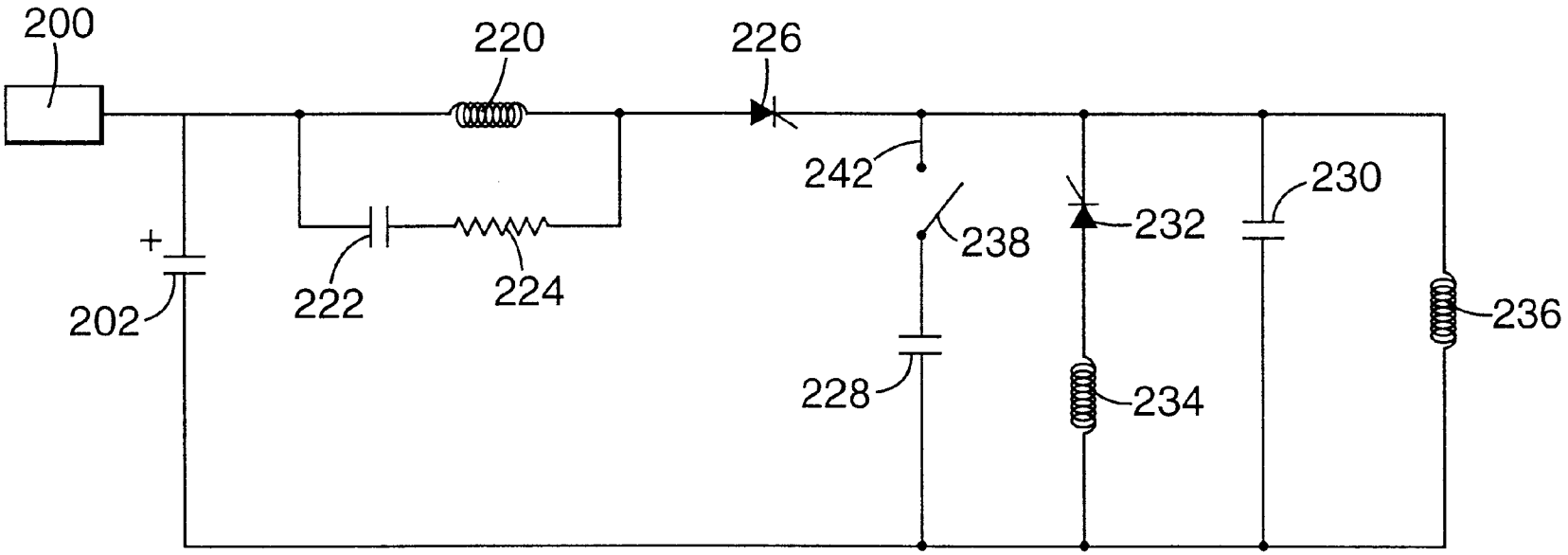
FIG. 3 is a circuit diagram illustrating a representative control circuit for a device used to activate and deactivate markers on, for example, magnetically-recorded videotapes according to the present invention.
Figure 4:
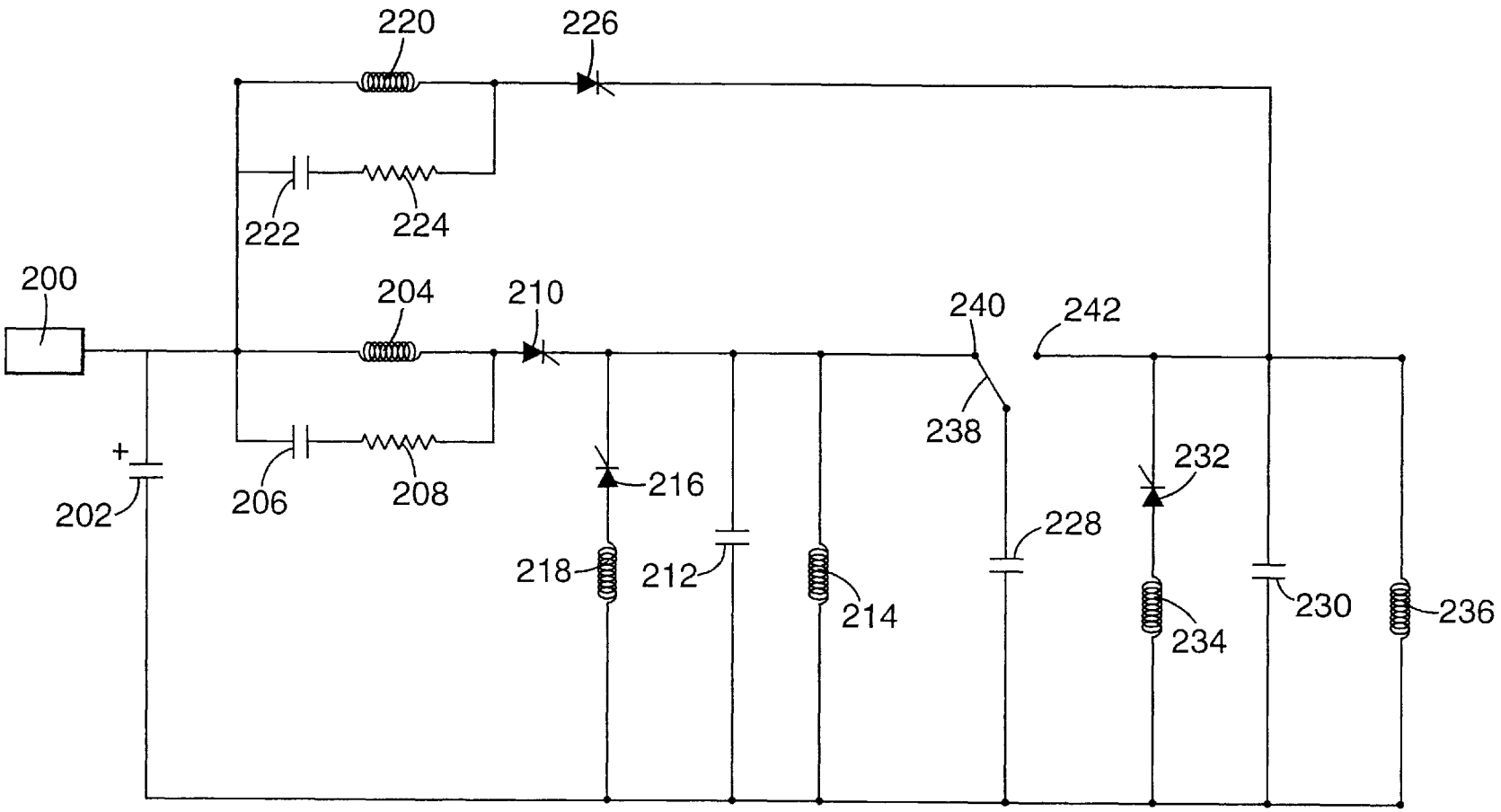
FIG. 4 is a circuit diagram illustrating a representative control circuit for a device used to activate and deactivate markers on a variety of library materials, including magnetically-recorded videotapes, according to the present invention.

The circuit diagram shown in FIG. 3 illustrates one representative control circuit. Characteristics of one representative set of components of the control circuits depicted in FIGS. 3 and 4 are indicated in Table 1, below.

The device may be powered by a power source 200, which is preferably direct current (DC), that is paired with a capacitor 202 to provide a uniform power output to the remainder of the control circuit. Power is provided to inductor 220, which is connected in parallel to capacitor 222 and resistor 224. This LRC circuit prevents silicon control rectifier (SCR) 226 from turning on shortly after it is turned off, as described below. The power source charges capacitor 230 to the appropriate voltage, and when the current in the circuit reaches zero, SCR 226 turns off and inductor 236 rings down, preferably over a relatively long period of time. That period of time depends on the characteristics of the circuit, including the Q value of the circuit (defined as the ratio of the reactive impedance to the resistance in the circuit). When the inductor 236 rings down over a relatively long period of time, preferably within an exponential envelope exhibiting a constant percentage decrease between adjacent positive peaks of between 30–38%, then the signal blocking layer associated with a conventional EAS marker can be reliably deactivated. When activating the signal blocking layer, ring down is stopped at the completion of one half of a sine wave (one positive peak), and the remainder of the current is bled off to ground by SCR 232 and inductor 234. Ring down is stopped at the completion of one half of a sine wave by SCR 232 and inductor 234 preventing the current in the circuit from going negative. By preventing the current from going negative, the circuit will switch, thus keeping the magnetic field from going above the absolute value of the coercivity of the markers in the opposite direction. The circuit of FIG. 3 further includes capacitor 228 that selectively connects to the remainder of the circuit via switch 238.

The circuit of FIG. 3 could be used, for example, within or in conjunction with the device shown in FIG. 1 or 2 to activate and deactivate EAS markers on videotapes or compact discs. Switch 238 can either be open (such as shown in FIG. 3) or contacting pole 242, as controlled, preferably, by an appropriate computer control system. When switch 238 is in the open position, the circuit can be used to activate and deactivate markers on a videotape, and when switch 238 is closed to contact pole 242, thereby adding additional capacitance to the circuit, the circuit can be used to activate and deactivate markers on compact discs.

For certain EAS markers used to mark compact discs, such as those described in U.S. Pat. Nos. 5,825,292 and 5,699,047 (Tsai et al.), the combined capacitance of capacitors 228 and 230 is set to, for example, 68 microFarads, to insure that the marker is reliably activated and deactivated no matter what position it is in relative to the applied field. This can be achieved, in one exemplary embodiment, by having the capacitance of capacitors 228 and 230 to be 60 microFarads and 8 microFarads, respectively. The field required to reliably activate and deactivate markers placed on videotapes can be much lower than that used for books and compact discs if the orientation of the EAS marker is generally known. For example, where the EAS marker is oriented parallel to the length of the device, a capacitor 230 having a capacitance of 8 microFarads may produce a field sufficient to activate and deactivate the EAS marker reliably without damaging the videotapes.

FIG. 4 is another exemplary circuit diagram of a control circuit that can be used to activate and deactivate the EAS markers associated with various items using fields of different intensity, and incorporates aspects of the circuit shown in FIG. 3. That is, the control circuit shown in FIG. 4 can be used to activate and deactivate EAS markers on videotapes as described above, but can also activate and deactivate EAS markers on books and compact discs. If a housing is used to contain a coil such as the solenoid-type coils described herein, the opening for the housing should be sufficiently large to enable various types of materials to pass into the housing.

As shown in FIG. 4, switch 238 can contact either or neither of poles 240 or 242, as determined, preferably, by an appropriate computer control system. If switch 238 doesn't contact either of poles 240 or 242, then the circuit operates in the manner described above and can be used to deactivate EAS markers on books or videotapes, dependant upon whether SCR 210 or 226 is activated, respectively. If, as shown in FIG. 4, switch 238 contacts pole 240, then capacitor 228 is connected into the circuit and adds its capacitance thereto. If the capacitance of capacitor 228 is, for example, 60 microFarads, then the combined capacitance of the circuit is increased from 60 to 120 microFarads. Upon activation of SCR 210, inductor 214 is then caused to create a field that enables activation and deactivation of EAS markers associated with either books or compact discs.

Referring still to the circuit in FIG. 4, if switch 238 contacts pole 242, then capacitor 228 is switched into a circuit such as shown in FIG. 3, and similarly adds its capacitance thereto. If the capacitance of capacitor 230 is, for example, 8 microfarads (and assuming the capacitance of capacitor 228 is 60 microfarads, as stated above), then the combined capacitance of the circuit is increased from 8 to 68 microfarads. Upon activation of SCR 226, inductor 236, which can have an inductance of, for example, 3.15 millihenries, is then caused to create a field that enables the device to activate and deactivate EAS markers associated with, for example, CDs.

The following table provides circuit elements (and their characteristics) that may be used in the above-mentioned exemplary circuits.

TABLE 1

| | | |
|---|---|---|
| Power source 200: | 420 | volts DC |
| Capacitor 202: | 4600 | microFarads |
| Inductor 204: | 40 | microHenries |
| Capacitor 206: | 0.22 | microFarads |
| Resistor 208: | 47 | ohms |
| Resistor 224: | 47 | ohms |
| Capacitor 212: | 60 | microFarads |
| Inductor 214: | 800 | microHenries |
| Inductor 218: | 10 | microHenries |
| Inductor 220 | 40 | microHenries |

TABLE 1-continued

| | | |
|---|---|---|
| Capacitor 222 | 0.22 | microFarads |
| Capacitor 228 | 60 | microFarads |
| Capacitor 230 | 8 | microFarads |
| Inductor 236 | 3150 | microHenries |
| Inductor 234 | 10 | microHenries |

The SCRs of the type described above are currently available from International Rectifier, El Segundo, Calif. under the designation 25R1A120. These and other suitable control circuits and components may be used to operate the device of the present invention.

Inductor 236 can be provided in the form of a coil that acts, as described above, as a solenoid-type coil for activating and deactivating the EAS markers associated with items of interest. Coil 236 (because it would be used for videotapes) is preferably either round or generally round, because these shapes provide the most uniform field characteristics. The coil should also be designed to be as small as possible and yet still be able to accommodate the items of interest, because larger coils have greater resistance, require more power to operate, and reduce the Q value of the circuit. The devices shown in FIGS. 1 and 2, for example, could each include a coil inside, typically having multiple turns of metal wire that are generally concentrically arranged with respect to a central passageway or opening. In one embodiment, coil 236 is made of 12 gauge pure copper wire having a square cross-sectional profile (to provide more turns per unit of length along the coil), and includes 234 turns, and an inductance of 3.15 mH. A coil of this type is available from Mag-Con Engineering Inc. of Lino Lakes, Minn. under the designation number 7424.

V. Other Components and Features

The device of the present invention may also include one or more detection systems for determining when something is entering the device, or for determining what that object is, or both. For example, photo-detectors may be used, such that when an object entering the passageway interrupts a beam of visible or invisible light, a signal is generated that is indicative of the presence of an object. These types of sensors are well known in the art. More than one such sensor may be provided, so that a first sensor activates a detector that determines the type of item present, a second sensor activates the circuitry to activate or deactivate the EAS marker associated with one type of item (such as a compact disc), and a third sensor activates the circuitry to activate or deactivate the EAS marker associated with another type of item (such as a videotape). In this manner, the EAS markers associated with different kinds of items can be activated or deactivated at the optimal location within the device, to facilitate complete activation or deactivation of the EAS marker.

The detection system may be or include an RFID interrogator that interrogates and thereby obtains information from RFID tags associated with items used with the device. The RFID detection system typically includes a loop antenna and an antenna tuning circuit that matches the impedance of the antenna to the impedance of the RFID circuitry. The antenna and antenna tuning circuit are connected to the RFID interrogator. The RFID interrogator may be triggered by a signal produced by a photo-detector, or by any other suitable means including a manually activated switch. When the RFID interrogator interrogates the RFID tag, the tag responds with information that the interrogator or another system can use to determine the type of object to which the tag is attached. The device may then alter the properties of the magnetic field by, for example, increasing the magnetic field for objects that cannot be harmed by magnetic fields (such as books and optically-recorded media), to insure the complete and reliable activation or deactivation of the associated EAS marker. This can be effectuated by switching capacitance into or out of the circuit, as described above.

VI. Summary

The device of the present invention is particularly useful for library applications, because it speeds the process of checking library materials into and out of a library by eliminating the need to remove videotapes from their cases. Retail video rental establishments that currently use single-status EAS markers (EAS markers that can never be deactivated) may, through the use of the device of the present invention, instead use dual-status EAS markers with confidence that their inventory of videotapes will not be damaged when the EAS marker is activated or deactivated. This would also eliminate another common problem—the activation of detection systems in other establishments (such as libraries or stores) by the single-status EAS markers attached to videotapes from the video rental establishment.

Yet another benefit is the ability of the device of the present invention to reliably activate and deactivate markers that can be difficult to activate and deactivate when they are presented in certain orientations relative to conventional activation/deactivation devices. For example, EAS markers attached to compact discs may encounter an activation/deactivation device at a wide variety or orientations depending on how the disc is oriented within the case. The device of the present invention, because it can provide a high relatively uniform magnetic field with a circuit having a high Q value, can reliably activate or deactivate the EAS markers used on compact discs, because the high magnetic field and high Q value of the circuit compensates for markers on CDs presented in other than an optimal orientation.

These and other benefits of the present invention will be appreciated by persons of skill in the art, as will certain variations of the embodiments described herein. For example, a non-solenoid-type coil or other device that provides a substantially uniform magnetic field within an area of interest is also contemplated, such as a coil that is open along a portion of one side, although other modifications to the control circuitry would have to be made. Accordingly, the invention is limited not by those embodiments, but by the claims set forth below.

We claim:

1. A device for changing the status of a dual-status electronic article surveillance marker associated with magnetically-recorded videotape, comprising control circuitry including a coil for creating a magnetic field in an area of interest and a circuit in which the intensity of the magnetic field is varied by switching components into or out of the circuit, the control circuitry and coil adapted to create a substantially uniform magnetic field in the area of interest that is sufficiently intense to activate or deactivate the marker, but not sufficiently intense to damage the videotape.

2. The device of claim 1, wherein the substantially uniform magnetic field has an intensity of between 275 Gauss and 560 Gauss.

3. The device of claim 1, wherein the coil is a solenoid-type coil.

4. The device of claim 1, further comprising a housing containing the coil, wherein the housing defines a passageway extending through the coil for receiving the videotape.

5. The device of claim 4, wherein the passageway has a cross-sectional opening shaped to receive a videotape.

6. The device of claim 4, wherein the passageway has a cross-sectional opening shaped to receive a cased videotape.

7. The device of claim 1, further comprising a detection system for detecting the presence of the videotape.

8. The device of claim 7, wherein the detection system is an optical detection system.

9. The device of claim 7, wherein the detection system is an RFID interrogator that obtains information from an RFID tag associated with the videotape.

10. The device of claim 1, in combination with a videotape.

11. A method for changing the status of a dual-status electronic article surveillance marker associated with an item, comprising:

a) providing a coil having a passageway therethrough;

b) passing the item through the passageway;

c) detecting the type of item;

d) altering the intensity of the magnetic field to ensure reliable activation or deactivation of the marker associated with that type of item; and e) providing a substantially uniform magnetic field within the passageway to activate or deactivate the marker.

12. The method of claim 11, wherein the item is a magnetically-recorded videotape, and the substantially uniform magnetic field activates or deactivates the marker without damage to the videotape.

13. The method of claim 11, wherein the coil is a solenoid-type coil.

14. The method of claim 12, wherein the substantially uniform magnetic field has an intensity between 275 Gauss and 560 Gauss.

15. A device for changing the status of a dual-status electronic article surveillance marker on an item, comprising:

a) control circuitry, including a solenoid-type coil, for creating a magnetic field within the coil that has a substantially uniform intensity;

b) an opening within the coil to receive the item; and c) a detection system for detecting the type of item;

wherein the control circuitry adjusts the intensity of the magnetic field based on the type of item detected.

16. The device of claim 15, wherein the item is a book, compact disk, or magnetically-recorded videotape.

17. The device of claim 15, wherein the device further comprises a detection system for detecting the presence of the item.

18. The device of claim 15, wherein the device includes a housing, and the opening is dimensioned to receive a cased videotape in a predetermined orientation.

19. The device of claim 15, wherein the device includes a housing, and the opening is dimensioned to receive a cased compact disc in a predetermined orientation.

20. The device of claim 15, wherein the device includes a housing, and the opening is dimensioned to receive a cased videotape in a predetermined orientation, and a cased compact disc in a predetermined orientation.

21. The device of claim 18, wherein the control circuitry provides, when a magnetically-recorded videotape is detected, a substantially uniform magnetic field having an intensity of between 275 Gauss and 560 Gauss.

22. The device of claim 15, wherein the detection system is an RFID interrogation system for interrogating an RFID tag associated with the item to obtain information about the item.

23. A device for changing the status of a dual-status electronic article surveillance marker on a videotape or a compact disc, comprising:

a) control circuitry for creating a substantially uniform magnetic field to activate or deactivate the marker;

b) a housing having an opening formed therein, wherein the opening is dimensioned to receive a cased videotape in a predetermined orientation, and a cased compact disc in a predetermined orientation; and c) a detection system for detecting the presence of the videotape or compact disc;

wherein the substantially uniform magnetic field is created when a videotape or compact disc is detected, the intensity of the magnetic field being selected based on which item is detected.

24. A device for changing the status of a dual-status electronic article surveillance marker on an item, comprising:

a) a housing having an opening formed therein; and b) three detectors positioned such that an item inserted into the opening passes the detectors sequentially; and c) control circuitry for creating a substantially uniform magnetic field to activate or deactivate the marker;

wherein the first detector signals the control circuitry as to the presence of the item, the second detector signals the control circuitry to create the magnetic field of a first intensity if the item is of a first type, and the third detector signals the control circuitry to create a magnetic field of a second intensity if the item is of a second type.

* * * * *